US005225125A

United States Patent [19]

Wildfeuer et al.

[11] Patent Number: 5,225,125

[45] Date of Patent: Jul. 6, 1993

[54] PROCESS AND SEALING MATERIAL FOR PRODUCING THE LID GASKET OF SYNTHETIC RESIN LIDS FOR BLOW-MOLDED SYNTHETIC RESIN BARRELS

[75] Inventors: Eberhard Wildfeuer, Montabaur-Reckenthal; Thomas Erll, Helferskirchen, both of Fed. Rep. of Germany

[73] Assignee: Schutz-Werke GmbH & Co. KG, Selters, Fed. Rep. of Germany

[21] Appl. No.: 851,898

[22] Filed: Mar. 16, 1992

[30] Foreign Application Priority Data

Mar. 16, 1991 [DE] Fed. Rep. of Germany ..... 4108606

[51] Int. Cl.[5] ..... B29C 67/22

[52] U.S. Cl. ..... 264/46.6; 264/46.4; 264/69; 264/80; 264/102; 264/268; 264/300

[58] Field of Search ..... 264/80, 46.4, 46.6, 264/69, 102, 268, 300, 71; 427/223; 156/82

[56] References Cited

U.S. PATENT DOCUMENTS

| | | | |
|---|---|---|---|
| 2,566,596 | 9/1951 | Cantor | 264/102 |
| 3,052,926 | 9/1962 | Quinche et al. | 264/80 |
| 3,557,030 | 1/1971 | Simons | 264/268 |
| 4,060,439 | 11/1977 | Rosemund et al. | 156/82 |
| 4,130,213 | 12/1978 | Wszolek | 264/268 |
| 4,324,601 | 4/1982 | Dembicki et al. | 156/82 |
| 4,473,673 | 9/1984 | Williams et al. | 264/102 |
| 4,567,106 | 1/1986 | Sano et al. | 427/223 |
| 4,756,857 | 7/1988 | Dezio et al. | 264/268 |
| 4,988,467 | 1/1991 | Holdsworth et al. | 264/268 |

FOREIGN PATENT DOCUMENTS

| | | | |
|---|---|---|---|
| 1247605 | 8/1967 | Fed. Rep. of Germany | 264/80 |
| 1704927 | 8/1971 | Fed. Rep. of Germany . | |
| 3132949 | 3/1983 | Fed. Rep. of Germany | 264/102 |
| 3149020 | 5/1983 | Fed. Rep. of Germany | 156/82 |
| 90115902 | 12/1990 | Fed. Rep. of Germany . | |
| 2411692 | 7/1979 | France . | |
| 61-063442 | 4/1986 | Japan | 264/69 |
| 592599 | 2/1978 | U.S.S.R. | 264/102 |

*Primary Examiner*—Allan R. Kuhns
*Attorney, Agent, or Firm*—Young & Thompson

[57] ABSTRACT

A lid (1) is injection-molded of polyethylene, for a widemouthed barrel of a synthetic resin, and includes an outer rim (4) encompassing the barrel neck (3) and an inner rim (5) dipping into the barrel neck. The outer lid rim (4) and inner lid rim (5) form an annular space (7), an annular web (8) projecting axially from the base of this space. For producing the lid gasket (13), the annular space (7) is exposed to an open flame for activating the annular space surface. Subsequently the sealing material, preferably polyurethane, is injected from a foaming machine into the base of the annular space (7), and thereafter the lid (1) is vibrated in order to degasify the gasket (13). The sealing material, preferably consisting of foamed polyurethane, contains a parting compound having a long-term effect.

1 Claim, 1 Drawing Sheet

PROCESS AND SEALING MATERIAL FOR PRODUCING THE LID GASKET OF SYNTHETIC RESIN LIDS FOR BLOW-MOLDED SYNTHETIC RESIN BARRELS

FIELD OF THE INVENTION

The invention relates to a process for producing the lid gasket of synthetic resin lids for blow-molded synthetic resin barrels in accordance with DE 9,011,590 U 1, with an outer rim encompassing the barrel neck and an inner rim dipping into the barrel neck and projecting beyond the lid bottom below the barrel opening, as well as with an annular web molded to the base of the annular space between the outer lid rim and the inner lid rim, this web being surrounded by a molded-on sealing material consisting of foamed synthetic resin.

BACKGROUND OF THE INVENTION

It has been found in the industrial usage of the lidded barrel of the present type that the lid gasket will stick to the opening rim of the barrel, primarily in case of low outside temperature below 0° C., during which a vacuum can occur in the sealed barrel, so that the barrel lid can be opened only with difficulties.

SUMMARY OF THE INVENTION

The invention is based on the object of developing a process and a sealing material for producing the lid gasket for the synthetic resin barrel lid of the type discussed herein, permitting the manufacture of lid gaskets exhibiting permanent, good sealing properties and allowing easy opening of the barrel lids independently of the ambient surrounding temperature and the filling material of the barrel.

This object has been attained according to this invention by the features of the claim.

The manufacturing process and the sealing material of this invention make it possible to produce barrel lids that can be readily handled and are safe in operation, with a clamping ring closure for widemouthed barrels of a synthetic resin.

BRIEF DESCRIPTION OF THE DRAWINGS

The manufacturing process according to this invention will be described in greater detail below with reference to a barrel lid for a widemouthed barrel, illustrated in fragmentary views in the drawings, wherein.

DETAILED DESCRIPTION OF THE INVENTION

Figure 1:
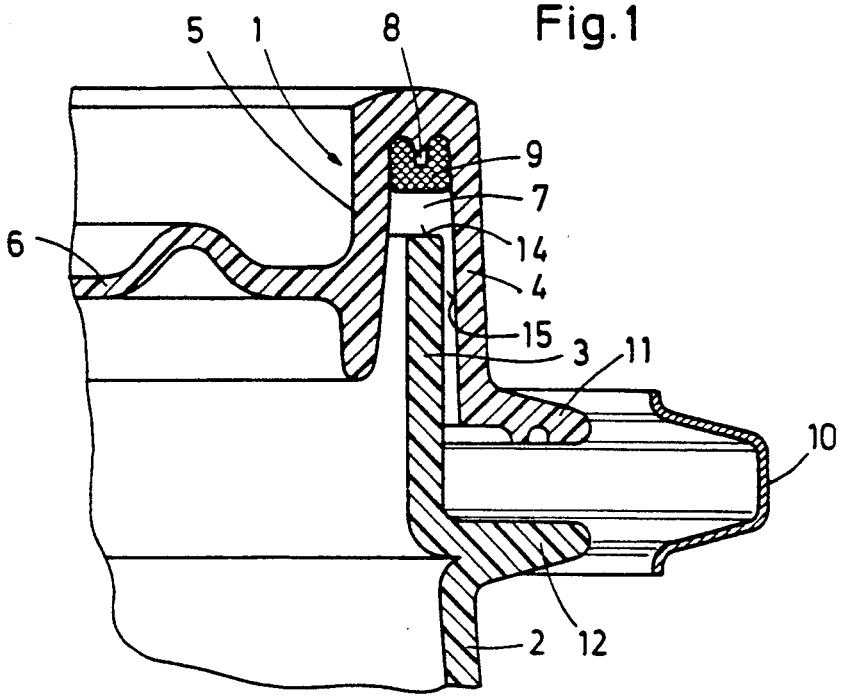
FIGS. 1 and 2 show the barrel neck zone of a widemouthed barrel with clamping ring closure, namely, in FIG. 1, with the lid being lifted off and, in FIG. 2, with the lid being closed.

The lid 1, injection-molded, for example, of polyethylene, in accordance with FIGS. 1 and 2 for a widemouthed barrel 2 blow-molded from a synthetic resin comprises an outer rim 4 surrounding the barrel neck 3 and an inner rim 5 dipping into the barrel neck 3 and projecting beyond the lid bottom 6 below the barrel opening. The outer lid rim 4 and the inner lid rim 5 form an annular space 7, an annular web 8 projecting axially from the base of this space. According to FIG. 1, the annular web 8 is surrounded by a molded-on sealing material 9 consisting of a foamed synthetic resin, for example polyurethane.

Figure 2:
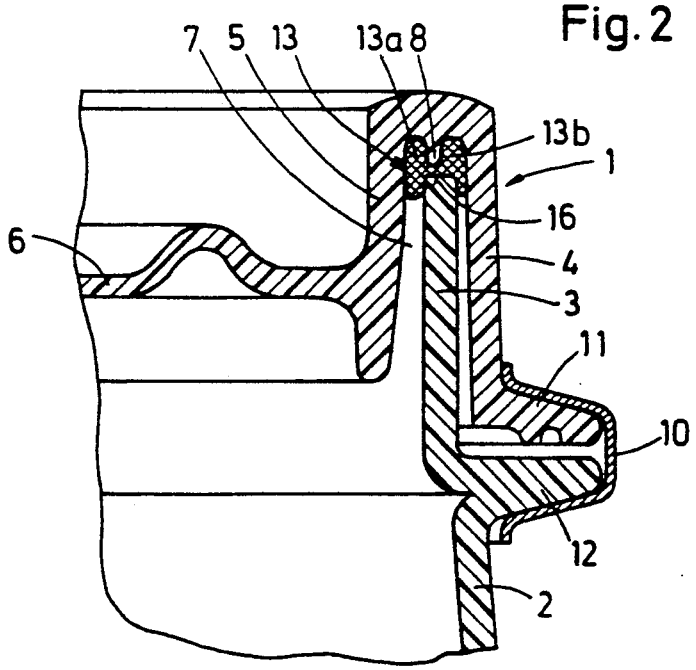

When closing the lid 1 by means of a clamping ring 10, which latter extends over a continuous flange 11 formed at the bottom on the outer lid rim 4 and subtends a solid edging 12 projecting radially outwardly at a spacing from the barrel wall below the barrel opening, the annular web 8, with division of the sealing material 9 into two sealing rings 13*a*, 13*b* constituting the lid gasket 13, is pressed onto the opening rim 14 of the barrel neck 3, the sealing rings 13*a*, 13*b* being pretensioned by way of the opening rim 14 (FIG. 2). With the clamping ring 10 being closed, a spacing is formed between the lid flange 11 and the barrel end 12 so that axial stresses acting on the lid 1 are introduced safely and directly into the barrel neck 3 and from there into the barrel body.

For producing the lid gasket 13, the annular space 7 on the inside of the lid 1 is exposed to an open flame to activate the surface 15 of the annular space. Subsequently the sealing material 9, preferably polyurethane, is injected with a foaming machine into the base of the annular space 7 and thereafter the lid 1 is vibrated to degasify the gasket 13. By the activation of the annular space surface 15, a permanent adhesive bond between the latter and the lid gasket 13 is achieved.

The sealing material 9, preferably consisting of foamed polyurethane, contains a parting compound with long-term effect which diffuses through the sealing material to the sealing surface 16 of the lid gasket 13 resting on the opening rim 14 of the barrel neck 3 and prevents sticking of the lid gasket 13 to the opening rim 14 of the widemouthed barrel 2 so that the lid 1 can be opened without any difficulties independently of the surrounding temperature and any vacuum that may prevail in the barrel.

What is claimed is:

1. In a process for producing a lid gasket of synthetic resin lids for blow-molded synthetic resin barrels, with an outer lid rim encompassing a barrel neck and with an inner lid rim dipping into the barrel neck and projecting beyond a barrel opening, as well as with an annular web molded to the base of an annular space between the outer lid rim and the inner lid rim, said web being surrounded by a molded-on sealing material comprised of foamed synthetic resin; the improvement comprising exposing the annular space (7) receiving the gasket (13) to an open flame on the inside of the lid (1), which is injection-molded from a synthetic resin, in order to activate a surface (15) of the annular space and enhance bonding between the gasket and the surface, subsequently injecting the synthetic resin sealing material (9) from a foaming machine into the annular space (7) to form the gasket, and thereafter vibrating the lid (1) in order to degasify the gasket (13).

* * * * *